US005258280A

United States Patent [19]

Suzuki

[11] Patent Number: 5,258,280

[45] Date of Patent: Nov. 2, 1993

[54] LIGHT-SENSITIVE SILVER HALIDE PHOTOGRAPHIC MATERIAL

[75] Inventor: Akiko Suzuki, Hino, Japan

[73] Assignee: Konica Corporation, Tokyo, Japan

[21] Appl. No.: 862,990

[22] Filed: Apr. 6, 1992

[30] Foreign Application Priority Data

Apr. 11, 1991 [JP] Japan ..... 3-079217

[51] Int. Cl.[5] ..... G03C 1/005; G03C 1/00

[52] U.S. Cl. ..... 430/567; 430/569; 430/600; 430/603; 430/611; 430/613

[58] Field of Search ..... 430/567-569, 430/611, 603, 613, 600

[56] References Cited

U.S. PATENT DOCUMENTS 2,476,536 7/1949 Dersch ..... 430/611
4,411,986 10/1983 Abbott et al. ..... 430/502
4,413,053 12/1983 Abbott et al. .
4,434,226 2/1984 Wilgus et al. ..... 430/567

FOREIGN PATENT DOCUMENTS 147882 4/1981 Fed. Rep. of Germany .
3644159 7/1987 Fed. Rep. of Germany .

*Primary Examiner*—Charles L. Bowers, Jr.
*Assistant Examiner*—Thorl Chea
*Attorney, Agent, or Firm*—Frishauf, Holtz, Goodman & Woodward

[57] ABSTRACT

A light-sensitive silver halide photographic material that can give an improved blackness of the silver-formed image by the development, having a high sensitivity with a high covering power, is disclosed. The material comprises a silver halide emulsion layer containing silver halide tabular grains which have an aspect ratio of not less than 3, covering not less than 50% of the total sum of projected areas, and the layer comprises a compound represented formula I,

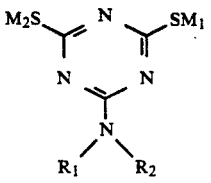

Formula I wherein Rs and Ms represent as specified in the claims.

13 Claims, No Drawings

LIGHT-SENSITIVE SILVER HALIDE PHOTOGRAPHIC MATERIAL

FIELD OF THE INVENTION

The present invention relates to a light-sensitive silver halide photographic material that can give an improved blackness of the image silver formed by development and also has a high sensitivity with a high covering power.

BACKGROUND OF THE INVENTION

Improvement of covering power of silver halide emulsions makes it possible to save silver weight necessary for attaining a given optical density, and hence is a very important subject for those who manufacture emulsions. For this reason, a number of proposals have been hitherto made. For example, U.S. Pat. Nos. 4,411,986, 4,434,226, 4,413,053, etc. disclose that the covering power of developed silver can be improved by the use of tabular grains obtained by making small the thickness of silver halide grains to have a high aspect ratio. Japanese Patent Publication Open to Public Inspection (hereinafter referred to as Japanese Patent O.P.I. Publication) No. 108526/1983 also discloses that a high sensitivity and a high covering power can be achieved by the use of what is called epitaxial grains formed by providing another silver salt on such tabular silver halide grains having a high aspect ratio. Besides the foregoing, it is also well known from a number of reports that tabular silver halide grains have a higher covering power than usual grains.

The tabular silver halide grains, however, impart without exception a yellowish tone to the image silver formed by photographic processing. This may consequently offend viewers when silver images are viewed as in, for example, X-ray light-sensitive photographic materials. This is due to the fact that the tone of images depends on the size of developed silver and the developed silver of a grain having a small grain thickness diffuses blue-color components to give a yellowish tone.

As a tone modifier of developed silver, a number of compounds are conventionally known, as exemplified by specific mercapto compounds, heterocyclics or hydrazine compounds. These conventional compounds, however, may inhibit the aforesaid high covering power that is characteristic of the tabular grain emulsions, and also may cause desensitization.

SUMMARY OF THE INVENTION

Accordingly, an object of the present invention is to provide a light-sensitive silver halide photographic material that has been made free from the above disadvantages involved in the prior art, can give a superior improved blackness of image silver, and also has a high sensitivity with a high covering power.

The above object can be achieved by the present invention as described below. That is, the object can be achieved by a light-sensitive silver halide photographic material comprising a support and, provided on at least one side thereof, a photographic component layer comprising a silver halide emulsion layer, wherein;

not less than 50% of the total sum of projected areas of silver halide grains contained in said silver halide emulsion layer is held by tabular grains having an aspect ratio, the ratio of grain diameter to grain thickness, of not less than 3 on the average; and said photographic component layer contains a compound represented by the following Formula I.

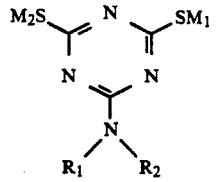

Formula I wherein $R_1$ and $R_2$ each represent a hydrogen atom, a saturated or unsaturated hydrocarbon group having 1 to 12 carbon atoms, that may have a substituent, or an aryl group that may have a substituent, and $R_1$ and $R_2$ may combine each other to form a heterocyclic ring; and $M_1$ and $M_2$ each represent a hydrogen atom or an alkali metal ion.

DETAILED DESCRIPTION OF THE INVENTION

The present invention will be described below in detail.

In the present invention, the above hydrocarbon group having 1 to 12 carbon atoms may include groups as exemplified by methyl, ethyl, propyl, butyl, allyl, propenyl, pentyl, cyclopentyl, hexyl, cyclohexyl, octyl and dodecyl. The group that may be substituted on these groups may include, for example, a halogen atom a cyano group, a hydroxyl group, an acyl group, an acetyl group, a benzoyl group and a carboxyl group. The aryl group represented by $R_1$ or $R_2$ may include a phenyl group and a naphthyl group. The group that may be substituted on the aryl group may include, for example, a halogen atom, a lower alkyl group, a lower alkoxyl group and a hydroxyl group. The heterocyclic ring that may be formed by $R_1$ and $R_2$ may include, for example, a morpholino group and a pyrrolidino group. The alkali metal ion may include, for example, sodium and potassium.

Examples of the compound represented by Formula I of the present invention are shown below.

I-1: 2-Amino-4,6-dimercapto-triazine
I-2: 2-Methylamino-4,6-dimercapto-triazine
I-3: 2-Ethylamino-4,6-dimercapto-triazine
I-4: Sodium 2-amino-4,6-dimercapto-triazine
I-5: 2-Pentylamino-4,6-dimercapto-triazine
I-6: 2-Octylamino-4,6-dimercapto-triazine
I-7: 2-Chloroethylamino-4,6-dimercapto-triazine
I-8: 2-Cyanoethylamino-4,6-dimercapto-triazine
I-9: 2-Acetoxyethylamino-4,6-dimercapto-triazine
I-10: 2-Dimethylamino-4,6-dimercapto-triazine
I-11: 2-Dipropylamino-4,6-dimercapto-triazine
I-12: 2-Di-t-butylamino-4,6-dimercapto-triazine
I-13: 2-N-ethyl-N-isoamylamino-4,6-dimercapto-triazine
I-14: 2-pyrrolidino-4,6-dimercapto-triazine
I-15: 2-Morpholino-4,6-dimercapto-triazine
I-16: 2-N-methylanilino-4,6-dimercapto-triazine
I-17: 2-o-Tolylamino-4,6-dimercapto-triazine
I-18: 2-N,N-diphenylamino-4,6-dimercapto-triazine
I-19: 2-Anilino-4,6-dimercapto-triazine
I-20: 2-(2,5-xylamino)-4,6-dimercapto-triazine
I-21: 2-Naphthylamino-4,6-dimercapto-triazine
I-22: 2-Benzylamino-4,6-dimercapto-triazine I-23: 2-p-Methoxyphenylamino-4,6-dimercapto-triazine
I-24: 2-Benzidino-4,6-dimercapto-triazine
I-25: Sodium 2-N-ethylanilino-4,6-dimercapto-triazine
I-26: 2-N-ethyl-p-tolylamino-4,6-dimercapto-triazine
I-27: 2-p-Chloroanilino-4,6-dimercapto-triazine
I-28: 2-Cyclopentylamino-4,6-dimercapto-triazine
I-29: 2-N,N-dichlorohexylamino-4,6-dimercapto-triazine
I-30: 2-N,N-diallylamino-4,6-dimercapto-triazine
I-31: 2-N-propenylamino-4,6-dimercapto-triazine
I-32: 2-N-methoxybenzoic acid amino-4,6-dimercapto-triazine.

The above dimercapto compounds can be readily synthesized by the methods disclosed in, for example, British Patents No. 1,141,773 and No. 1,376,600. They can also be synthesized by the method disclosed in Munio Kotake, DAI YUUKI KAGAKU (Grand Organic Chemistry), Asakura Shoten, 1971, or methods corresponding thereto.

The dimercapto compound according to the present invention is used in a light-sensitive silver halide photographic material having at least one layer containing tabular silver halide grains with an average aspect ratio of not less than 3. The compound may be added to any photographic component layer of the light-sensitive silver halide photographic material after it has been dissolved in water or a hydrophilic solvent as exemplified by methanol or ethanol. The photographic component layer is exemplified by a silver halide emulsion layer, a protective layer, an undercoat layer, an intermediate layer, a filter layer, an anti-halation layer, an antistatic layer and a backing layer, to any of which the compound may be added. The compound may preferably be added to a silver halide emulsion layer or a layer adjoining thereto, whereby the effect of the present invention can be better obtained. The dimercapto compound may be added to a silver halide emulsion at any time throughout emulsion preparation steps. It may preferably be added at any time of from the step of chemical ripening to the step of coating, and more preferably prior to the step of coating.

In the case when the compound of the present invention is directly added to the silver halide emulsion, it may be added in an amount ranging from 0.10 to 1,000 mg, and preferably from 1 to 500 mg, per mol of silver halide. When added to the layer other than the silver halide emulsion layer, it may also be added in an amount ranging from 0.10 to 1,000 mg, and preferably from 1 to 500 mg.

The tabular silver halide grains according to the present invention may preferably have an average grain size of from 0.2 to 3.0 μm, and particularly preferably from 0.5 to 2.0 μm.

The tabular silver halide grains of the present invention has a ratio of grain diameter to grain thickness (which is called aspect ratio), of not less than 3, preferably from 6 to 60, and more preferably from 7 to 50, as an average value (which is called average aspect ratio).

The tabular silver halide grains of the present invention may preferably have an average thickness of not more than 0.3 μm, more preferably not more than 0.1 μm or less, and particularly preferably from 0.01 to 0.08 μm.

In the present invention, the diameter of a silver halide grain is defined as a sphere-corresponding diameter of a grain, based on the observation of an electron microscope photograph of silver halide grains.

In the present invention, the thickness of a silver halide grain is defined as a minimum distance of the distance between two parallel surfaces constituting a tabular silver halide grain.

The thickness of the tabular silver halide grain can be determined based on a shaded electron microscope photograph of silver halide grains or an electron microscope photograph of a cross section of a sample obtained by coating a support with a silver halide emulsion followed by drying.

To determine the average aspect ratio, the measurement is made on at least one hundred samples.

In the silver halide emulsion used in the present invention, the tabular silver halide grains may be in a proportion of not less than 50%, preferably not less than 60%, and particularly preferably not less than 70%, of the whole silver halide grains.

As the tabular silver halide emulsion of the present invention, a monodisperse emulsion may preferably be used, and an emulsion comprising not less than 50% by weight of silver halide grains with a grain size embraced in the range of ±20% around the average grain size may particularly preferably used.

The tabular silver halide emulsion of the present invention may be of any composition such as silver chloride, silver bromide, silver iodide, silver chlorobromide or silver iodobromide. From the viewpoint of a high sensitivity, silver iodobromide is preferred, which may have an average silver iodide content of from 0.1 to 4.0 mol %, and particularly preferably from 0.5 to 3.0 mol %.

In the tabular silver halide emulsion of the present invention, the halogen composition may be uniform throughout a grain. Alternatively, silver iodide may be locally present, and those in which it is locally present at the center are preferably used.

The tabular silver halide emulsion can be prepared making reference to any methods disclosed in Japanese Patent O.P.I. Publications No. 113926/1983, No. 113927/1983, No. 113934/1983 and No. 1855/1987, European Patents No. 219,849 and No. 219,850, etc..

The monodisperse tabular silver halide emulsion can be prepared making reference to the method disclosed in Japanese Patent O.P.I. Publication No. 6643/1986.

The tabular silver iodobromide emulsion having a high aspect ratio can be prepared by adding an aqueous silver nitrate solution, or simultaneously adding an aqueous silver nitrate solution and an aqueous halide solution, in an aqueous gelatin solution kept at a pBr of not more than 2, to produce seed crystals, which are then grown by double-jet precipitation.

The size of the tabular silver halide grains can be controlled by adjusting temperatures when grains are formed, and the rates of addition of aqueous silver salts and halide solutions.

The average silver iodide content of the tabular silver halide emulsion can be controlled by changing the composition of the aqueous silver halide solution to be added, that is, the proportion of bromide and iodide.

In the preparation of the tabular silver halide grains, a silver halide solvent can be optionally used, as exemplified by ammonia, thioether or thiourea.

In order to remove soluble salts, the emulsion may be subjected to washing such as noodle washing or flocculation sedimentation. Preferred methods of washing are exemplified by a method making use of a sulfo group-containing aromatic hydrocarbon aldehyde resin as disclosed in Japanese Patent Examined Publication No.

16086/1960 and a method making use of a high-molecular flocculating agent, exemplary agents G3, G8, etc., as disclosed in Japanese Patent O.P.I. Publication No. 158644/1988, which are particularly preferred desalting methods.

The emulsion used in the light-sensitive silver halide photographic material of the present invention can be prepared by known methods. For example, they can be prepared by the methods disclosed in Emulsion Preparation and Types, Research Disclosure (RD) No. 17643, December 1978, pp. 22–23, and in RD No. 18716, November 1979, p. 648.

The emulsion used in the light-sensitive silver halide photographic material according to the present invention can be prepared by, for example, the method disclosed in T. H. James, "The Theory of the Photographic Process", Fourth Edition, published by Macmillan Publishing Co., Inc. (1977), pages 38–104, and the methods disclosed in G. F. Dauffin, "Photographic Emulsion Chemistry", published by Focal Press Co. (1966), P. Glafkides, "Chemie et Physiquephotographique", published by Paul Montel Co. (1967), and V. L. Zelikman et al, "Making and Coating Photographic Emulsion", published by Focal Press (1964), etc..

More specifically, the emulsion can be prepared by selecting solution conditions of the neutral method, the acid method, the ammonia method, etc., mixing conditions of normal precipitation, reverse precipitation, double-jet precipitation, controlled double-jet precipitation, etc. and grain preparation conditions of the conversion method, the core/shell method, etc., and using any combination of these. As a preferred embodiment of the present invention, the emulsion is a monodisperse emulsion comprising silver iodide localized in the inside of a grain.

In the emulsion according to the present invention, various photographic additives can be used in the step anterior or posterior to physical ripening or chemical ripening. Known additives may include the compounds as disclosed in, for example, Research Disclosures No. 17643 (December 1978), No. 18716 (November 1979) and No. 308119 (December 1989). Kinds of the compounds disclosed in these three Research Disclosures and the paragraphs or columns in which they are described are shown in the following table.

| | RD-17643 | | RD-18716 | | RD-308119 | |
|---|---|---|---|---|---|---|
| Additives | Page | Par. | Page | Column | Page | Par. |
| Chemical sensitizer: | 23 | III | 648 | right, upper | 996 | III |
| Spectral sensitizer: | 23 | IV | 648–9 | | 996–8 | IV |
| Desensitizer | 23 | IV | | | 998 | B |
| Dye | 25–26 | VIII | 649–650 | | 1,003 | VIII |
| Development accelerator: | 29 | XXI | 648 | right, upper | | |
| Fog restrainer, Stabilizer: | 24 | IV | 649 | right, upper | 1,006–7 | VI |
| Brightener: | 24 | V | | | 998 | V |
| Hardening agent: | 26 | X | 651 | left | 1,004–5 | X |
| Surfactant: | 26–27 | XI | 650 | right | 1,005–6 | XI |
| Antistatic agent: | 27 | XII | 650 | right | 1,006–7 | XIII |
| Plasticizer: | 27 | XII | 650 | right | 1,006 | XII |
| Lubricant: | 27 | XII | | | | |
| Matting agent | 28 | XVI | 650 | right | 1,008–9 | XVI |
| Binder: | 26 | XXII | | | 1,003–4 | IX |
| Support: | 28 | XVII | | | 1,009 | XVII |

The support that can be used in the light-sensitive material according to the present invention may include, for example, the supports as described in RD-17643, page 28, and RD-308119, page 1,009.

Suitable supports may include plastic films. The surfaces of these supports may be provided with an undercoat layer or subjected to corona discharging or ultraviolet irradiation so that the adhesion of coating layers can be improved.

EXAMPLE

The present invention will be described below by giving an examples. As a matter of course, the present invention is by no means limited by the following example.

(1) Preparation of polydisperse emulsion:

Prepared by normal precipitation, using the following four kinds of solutions.

| | |
|---|---|
| Solution A: | |
| Silver nitrate | 10 g |
| Ammonia water (28%) | 78 ml |
| By adding water, made up to | 240 ml |
| Solution B: | |
| Ossein elatin | 8 g |
| Potassium bromide | 80 g |
| Potassium iodide | 1.3 g |
| By adding water, made up to | 550 ml |
| Ammonia water | 6 ml |
| Solution C: | |
| Glacial acetic acid | 10 ml |
| Water | 34 ml |
| Solution D: | |
| Glacial acetic acid | 226 ml |
| By adding water, made up to | 400 ml |

Solutions B and C were charged in a reaction vessel for use in the preparation of emulsions, followed by stirring using a propeller stirrer at a revolution number of 300 r.p.m., and the reaction temperature was kept at 55° C.

Next, solution A was divided in a proportion of 1:2 (volume ratio), and a portion of 100 ml thereof was charged in 1 minute. After the stirring was continued for 10 minutes, the remaining 200 ml of solution A was charged in 10 minute. The stirring was further continued for 30 minutes. Subsequently, solution D was added, the pH of the solution in the reaction vessel was adjusted to 6.0, and then the reaction was stopped.

(2) Preparation of monodisperse grain emulsion:

Using, as nuclei, good monodisperse emulsion grains of silver iodobromide having an average grain size of 0.2 μm, containing 2.0 mol % of silver iodide, having the form of a cube and having a coefficient of variation, which measures monodispersity, of 0.15, silver iodobromide grains containing 30 mol % of silver iodide were grown under conditions of pH 9.8 and pAg 7.8. Thereafter, potassium bromide and silver nitrate were added in equimolar amounts under conditions of pH 8.2 and pAg 9.1. An emulsion comprising monodisperse emulsion grains of tetradecahedrons with an average grain size of 0.90 μm and having a coefficient of variation of 0.16 was thus prepared so as to give silver iodobromide grains having an average silver iodide content of 2.2 mol %.

(3) Preparation of tabular grain emulsion:

To 5.5 lit. of an aqueous 1.5% gelatin solution containing 0.17 mol of potassium bromide, potassium bromide and silver nitrate corresponding to 2.1 mol and 2.0 mol, respectively, in the form of aqueous solutions were added by double-jet precipitation over a period of 3 minutes with stirring at 80° C. and pH 5.7. The pBr was maintained to 0.8. (0.53% of the whole silver nitrate used was consumed).

The addition of the aqueous potassium bromide solution was stopped, and the addition of the aqueous silver nitrate solution was continued for 4.6 minutes. (8.6% of the whole silver nitrate used was consumed). Subsequently, the aqueous potassium bromide solution and aqueous silver nitrate solution were simultaneously added for 12 minutes. During this addition, the pBr was maintained to 1.15, and the addition flow rate was accelerated so as for the rate at the time of completion to become 2.3 times that at the time of initiation. (43.6% of the whole silver nitrate used was consumed).

The addition of the aqueous potassium bromide solution was stopped, and the aqueous silver nitrate solution was added for 1 minute. (4.7% of the whole silver nitrate used was consumed).

An aqueous 2.1 mol potassium bromide solution containing 0.55 mol of potassium iodide was added over a period of 12.0 minutes together with the aqueous silver nitrate solution. During this addition, the pBr was maintained to 1.7, and the flow rate was accelerated so as for the rate at the time of completion to become 1.5 times that at the time of initiation. (35.9% of the whole silver nitrate used was consumed). To the resulting emulsion, 1.5 g/mol.Ag of sodium thiocyanate was added, which was then maintained for 25 minutes. Potassium iodide corresponding to 0.60 mol and the silver nitrate were added by double-jet precipitation at equal flow rates for about 5 minutes until the pBr reached 3.0. (6.6% of the whole silver nitrate used was consumed). The whole silver nitrate consumed was in an amount of about 11 mol. An emulsion was thus prepared, containing tabular silver iodobromide grains with an average grain diameter of 0.90 μm and an aspect ratio of about 11:1.

In the resulting grains, 80% or more of the whole projection areas of the silver iodobromide grains were held by tabular grains.

The three kinds of emulsions thus obtained were each subjected to desalting using a conventional flocculation process to remove excessive salts. More specifically, the desalting was carried out, while maintaining the emulsion at 40° C., by adding a formalin condensate of sodium naphthalenesulfonate and an aqueous solution of magnesium sulfate to effect flocculation, followed by removal of the supernatent liquid.

PREPARATION OF SAMPLES, PROCESSING, AND EVALUATION

To the silver halide emulsions (1), (2) and (3) each thus obtained, pure water was added so as to give a volume of 500 ml per mol of silver, and thereafter the mixture was maintained at 55° C. Then, spectral sensitizers A and B set out later were added in a weight ratio of 200:1 so as to give their total weight of 600 mg per mol of silver halide.

After 10 minutes, ammonium thiocyanate, chloroauric acid and hypo were added in appropriate amounts to initiate chemical ripening.

This chemical ripening was carried out under conditions of a pH of 6.15 and a silver potential of 50 mV.

At 15 minutes before completion of the chemical ripening (i.e. 70 minutes after initiation of the chemical ripening), potassium iodide was added in an amount of 200 mg per mol of silver. After 5 minutes, 10% (wt/vol) of acetic acid was added to lower the pH to 5.6, and this pH value was maintained for 5 minutes. Thereafter, an aqueous 0.5% (wt/vol) potassium hydroxide solution was added to restore the pH to 6.15, followed by addition of 4-hydroxy-6-methyl-1,3,3a,7-tetrazaindene. The chemical ripening was thus completed.

To the resulting emulsions (1), (2) and (3), the emulsion additives as set out later were added. Preparation solutions (photographic emulsion coating solutions) were thus prepared.

These photographic emulsion coating solutions were so prepared that they had a pH of 6.40 and a silver potential of 74 mV (35° C.) after their preparation, using sodium carbonate and potassium bromide.

Using these emulsion coating solutions, samples were prepared in the following way: The photographic emulsion layers were so formed as to have a gelatin weight of 2.0 g/m$^2$ per each side, and have a silver halide weight of 1.8 g/m$^2$ in terms of silver.

A protective layer coating solution was also prepared using the additives as set out later. The protective layer was formed together with the above emulsion layers so as to have a gelatin coating weight of 1.15 g/m$^2$, using two sets of slide hopper type coaters, where a support was coated thereon with the emulsion coating solution by both-side simultaneous coating at a coating speed of 80 m per minute, followed by drying in 2 minutes and 20 seconds. The samples were thus obtained. As the support, a 175 μm thick polyethylene terephthalate film base used for X-ray films and colored in blue with a density of 0.15 was used, which had been coated with a subbing solution comprising a water-based copolymer dispersion obtained by diluting to a concentration of 10% by weight a copolymer comprising three kinds of monomers of 50% by weight of glycidyl dimethacrylate, 10% by weight of methyl acrylate and 40% by weight of butyl methacrylate.

Spectral sensitizer A:

Anhydroys sodium 5,5'-dichloro-9-ethyl-3,3'-di-(3-sulfopropyl)oxacarbocyanine.

Spectral sensitizer B:

Anhydrous sodium 5,5'-di-(butoxycarbonyl)-1,1'-diethyl-3,3'-di-(4-sulfobutyl)benzoimidazolocarbocyanine.

The additives used in the emulsion coating solutions are as follows. The amounts of the additives are each indicated as weight per mol of silver halide.

| | |
|---|---|
| 1,1-Dimethylol-1-bromo-1-nitromethane | 70 mg |
| t-Butylcatechol | 400 mg |
| Polyvinylpyrrolidone (molecular weight: 10,000) | 1.0 g |
| Styrene/maleic anhydride copolymer | 2.5 g |
| Nitrophenyl-triphenylphosphonium chloride | 50 mg |
| Ammonium 1,3-dihydroxybenzene-4-sulfonate | 4 g |
| Sodium 2-mercaptobenzimidazole-5-sulfonate | 1.5 mg |
| $C_4H_9OCH_2CH(OH)CH_2N(CH_2COOH)$ | 15 mg |
| 1-Phenyl-5-mercaptotetrazole | 15 mg |

-continued

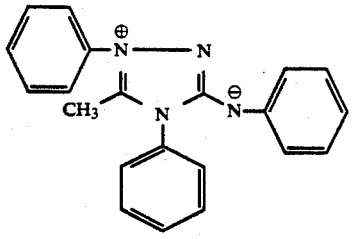

150 mg

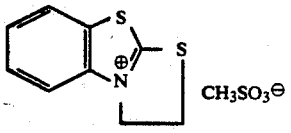

70 mg

| | |
|---|---|
| Dye-emulsified dispersion* | 1.2 g |
| The additives used in the protective layer coating solution are as follows. The amounts of the additives are each indicated as weight per mol of silver halide. | |
| Lime-treated inert gelatin | 68 g |
| Acid-treated gelatin | 2 g |
| Sodium-i-amyl-n-decylsulfosuccinate | 0.3 g |
| Polymethyl methacrylate (a matting agent with an area average particle diameter of 3.5 μm) | 1.1 g |
| Silicon dioxide particles (a matting agent with an area average particle diameter of 1.2 μm) | 0.5 g |
| LUDOX AM (tradename; available from DuPont Co.) (colloidal silica) | 30 g |
| Aqueous 2% solution of sodium 2,4-dichloro-6-hydroxy-1,3,5-triazine (a hardening agent) | 10 ml |
| $(CH_2{=}CHSO_2CH_2)_2O$ (a hardening agent) | 500 mg |
| $C_{12}H_{25}CONH(CH_2CH_2O)_5H$ | 2.0 g |
| Aqueous 40% glyoxal solution (a hardening agent) | 1.5 ml |

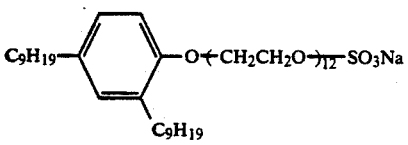

1.0 g

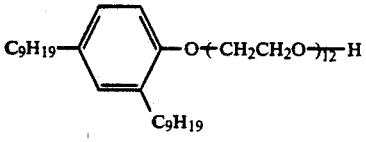

0.4 g

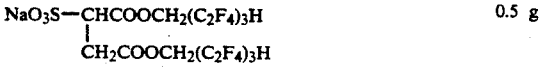

0.5 g

*The dye-emulsified dispersion was prepared in the following way.

The following dye was weighed in an amount of 10 kg, and was added at 55° C. to a solvent comprised of 28 lit. of tricresyl phosphate and 85 lit. of ethyl acetate. The resulting solution is called an oil-based solution. Meanwhile, 270 ml of aqueous 9.3% gelatin solution in which 1.35 kg of anionic surface active agent (the following AS) was dissolved at 45° C. was prepared. This solution is called a water-based solution.

The above oil-based solution and water-based solution were put in a dispersion vessel, and were dispersed while controlling the liquid temperature to be kept at 40° C. To the resulting dispersion, 8 g of additive C shown below, 16 lit. of an aqueous 2.5% phenol solution and water were added to make up the dispersion to 240 kg, followed by cooling to effect solidification.

Dye:

-continued

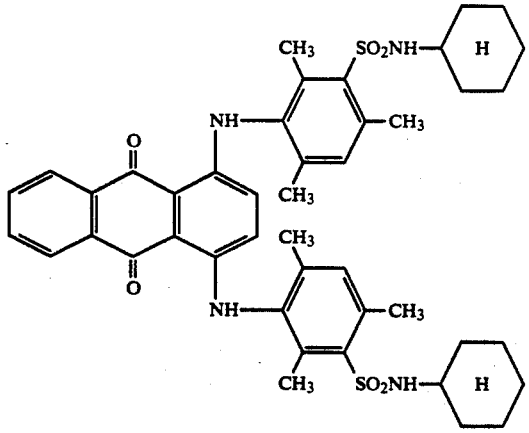

AS:

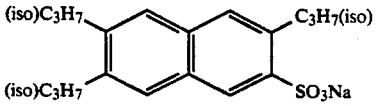

C:

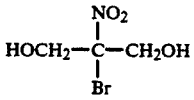

The dispersion thus obtained had an area average particle diameter within the range of from 0.12 to 0.14 μm.

The samples thus obtained were exposed to white light according to a JIS method, using a KS-1 type sensitometer (manufactured by Konica Corporation), followed by processing using a continuous transport type automatic processer capable of continuously carrying out developing, fixing, washing and drying. Processing solutions used and conditions for the photographic processing are shown below.

PROCESSING CONDITIONS

Automatic processor

Using SRX-501, manufactured by Konica Corporation, the samples were processed in the processing mode of 45 seconds. The processing was carried out at a developing bath temperature of 35° C. and a fixing bath temperature of 33° C. Washing water was kept at 18° C. and fed at a rate of 4 lit. per minute. Drying was carried out at a temperature of 45° C. The environmental conditions of the room in which the automatic processor was placed were 25° C. and 60% RH.

FORMULATION OF DEVELOPING SOLUTION

| Part-A (for making up to 38 lit.) | |
|---|---|
| potassium hydroxide | 1,140 g |
| potassium sulfite | 2,280 g |
| Sodium hydroencarbonate | 266 g |
| Boric acid | 38 g |
| Diethylene glycol | 418 g |
| Ethylenediaminetetraacetic acid | 61 g |
| 5-Methylbenzotriazole | 1.9 g |
| Hydroquinone | 1,064 g |
| Made up to 9.3 lit. by adding water. | |

-continued

| | |
|---|---|
| Part-B (for making up to 38 lit.) | |
| Glacial acetic acid | 418 g |
| Triethylene glycol | 418 g |
| 1-Phenyl-3-pyrazolidone | 100 g |
| 5-Nitroindezole | 9.5 g |
| Made up to 1.0 lit. by adding water. | |
| Part-C (for making up to 38 lit.) | |
| Glutaldehyde (50 wt/wt %) | 304 g |
| Sodium metabisulfite | 38 g |
| Made up to 770 ml by adding water. | |
| Starter | |
| Glacial acetic acid | 230 g |
| Potassium bromide | 200 g |
| Made up to 1.5 lit. by adding water. | |

PREPARATION OF DEVELOPING SOLUTION

In a replenishing solution stock tank, 20 lit, of water kept at 18° C. was put, to which the above Part-A, Part-B and Part-C were successively added with stirring, and water and an aqueous potassium hydroxide solution were finally added to make up the solution to 38 lit. with pH 10.53 at 25° C. This developing replenishing solution was left to stand for 24 hours at 25° C., and thereafter the starter was added thereto in an amount of 20 ml per liter. Then a developing tank of the automatic processor manufactured by Konica Corporation was filled with the solution. Here, the developing solution had a pH of 10.26 at 25° C.

The developing replenishing solution was supplied in an amount of 365 ml per 1 $m^2$ of the sample of the present invention.

FORMULATION OF FIXING SOLUTION

| | |
|---|---|
| Part-A (for making up to 38 lit.) | |
| Ammonium thiosulfate | 6,080 g |
| Disodium ethylenediaminetetraacetate dihydrate | 0.76 g |
| Sodium sulfite | 456 g |
| Boric acid | 266 g |
| Sodium hydroxide | 190 g |
| Glacial acetic acid | 380 g |
| Made up to 9.5 lit. by adding water. | |
| Part-B (for making up to 38 lit.) | |
| Aluminum sulfate in terms of anhydrous salt) | 570 g |
| Sulfuric acid (50 wt %) | 228 g |
| Made up to 1.9 lit. by adding water. | |

PREPARATION OF FIXING SOLUTION

In a replenishing solution stock tank, 20 lit. of water kept at 18° C. was put, to which the above Part-A and Part-B were successively added with stirring, and water and an aqueous potassium hydroxide solution were finally added to make up the solution to 38 lit. with pH 4.20 at 25° C. This fixing replenishing solution was left to stand for 24 hours at 25° C., and thereafter a fixing tank of the automatic processor manufactured by Konica Corporation was filled with the solution. The fixing replenishing solution was supplied in an amount of 640 ml per 1 $m^2$ of the sample of the present invention.

On each sample, sensitometry was carried out and also tone of developed silver and covering power were examined to obtain the results as shown in Table 1. In the table, the sensitivity is indicated as a relative sensitivity, regarding the sensitivity of comparative sample No. 1 as 100. The covering power was determined in the following way: The sample was exposed to light so as to give a maximum density, and thereafter processed in the mode of 45 seconds under the processing conditions as previously described. Silver weight ($dm^2$) of the resulting sample was measured by fluorescent X-ray analysis, and the value of density was divided by the silver weight to determine the covering power. The larger the value is, the better the covering power is.

With regard to the tone of developed silver, each sample having been photographically processed was visually observed to evaluate the tone on the basis of the following four ranks.

A: Black
B: Slightly greenish black
C: Slightly yellowish black
D: Yellowish black.

Results obtained are shown in Table 1.

TABLE 1

| Sample No. | Emulsion | Compound Symbol | Compound (mg/molAgX) | Sensitivity | Silver tone | Covering power | Remarks |
|---|---|---|---|---|---|---|---|
| 1 | (1) | — | — | 100 | A | 90 | X |
| 2 | (1) | A* | 15 | 90 | A | 90 | " |
| 3 | (1) | I-2 | 15 | 90 | A | 90 | " |
| 4 | (2) | — | — | 107 | A | 94 | " |
| 5 | (2) | A* | 15 | 89 | A | 94 | " |
| 6 | (2) | I-2 | 15 | 89 | A | 94 | " |
| 7 | (3) | — | — | 123 | D | 130 | " |
| 8 | (3) | A* | 15 | 118 | C | " | " |
| 9 | (3) | " | 100 | 90 | B | " | " |
| 10 | (3) | I-2 | 15 | 118 | A | " | Y |
| 11 | (3) | " | 100 | 110 | A | " | " |
| 12 | (3) | I-7 | 15 | 117 | A | " | " |
| 13 | (3) | " | 100 | 109 | A | " | " |
| 14 | (3) | I-10 | 15 | 117 | A | " | " |
| 15 | (3) | " | 100 | 108 | A | " | " |
| 16 | (3) | I-18 | 15 | 116 | A | " | " |
| 17 | (3) | " | 100 | 106 | A | " | " |
| 18 | (3) | I-23 | 15 | 118 | A | " | " |
| 19 | (3) | " | 100 | 108 | A | " | " |
| 20 | (3) | I-27 | 15 | 119 | A | " | " |
| 21 | (3) | " | 100 | 109 | A | " | " |

A*: I-Phenyl-5-mercaptotetrazole (comparative compound)
X: Comparative Example, Y: Present Invention As is clear from Table 1, the samples according to the present invention are seen to have been improved in the tone of image silver to give a black color, and also have a high covering power.

The present invention has made it possible to obtain a light-sensitive silver halide photographic material having a high sensitivity and a high covering power, and also capable of forming a blacky silver image. The present invention has also proved particularly effective for light-sensitive materials wherein silver images are viewed as in, for example, X-ray light-sensitive photographic materials.

What is claimed is:

1. A silver halide light-sensitive photographic material comprising:

a support having thereon, at least one side thereof, photographic component layers, including a silver halide emulsion layer comprising silver halide grains, wherein not less than 50% of a total sum of projected areas of the silver halide grains contained in the silver halide emulsion layer is of tabular grains having an average aspect ratio of not less than 3, and said silver halide emulsion layer further comprises a compound represented by formula I,

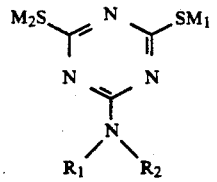

Formula I wherein $R_1$ and $R_2$ each represent a hydrogen atom, a saturated or unsaturated hydrocarbon group having 1 to 12 carbon atoms, that may have a substituent, or an aryl group that may have a substituent, and $R_1$ and $R_2$ may combine each other to form a heterocyclic ring; and $M_1$ and $M_2$ each represent a hydrogen atom or an alkali metal ion.

2. The material of claim 1, wherein a content of the compound represented by formula I is 1 to 500 mg per mol of the silver halide grain.

3. The material of claim 1, wherein an average grain size of the tabular silver halide grain is 0.5 to 2.0 μm.

4. The material of claim 1, wherein the average aspect ratio is 8 to 20.

5. The material of claim 1, wherein an average thickness of the tabular silver haliide grain is 0.01 to 0.1 μm.

6. The material of claim 1, wherein an average thickness of the tabular silver halide grain is 0.01 to 0.08 μm.

7. The material of claim 1, wherein a content of silver iodide is 0.5 to 3.0 mol % of silver halide.

8. A silver halide light-sensitive photographic material comprising:

a support having thereon, at least one side thereof, a plurality of photographic component layers, including a silver halide layer, being formed from a silver halide emulsion, comprising silver halide grains, wherein not less than 80% of a total sum of projected areas of the silver halide grains, contained in the silver halide layer, is formed by a plurality of tabular grains having an average aspect ratio of not less than 11, and average grain size of 0.5 to 2.0 μm; and said silver halide layer further comprises 1 to 500 mg of a compound represented by formula I, in 1 mol of silver halide,

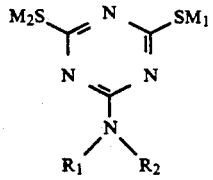

Formula I wherein $R_1$ and $R_2$ each represents a hydrogen atom ion, a saturated or unsaturated hydrocarbon group having 1 to 12 carbon atoms that may have a substituent, or an aryl group that may have a substituent, and $R_1$ and $R_2$ may combine each other to form a heterocyclic ring; and $M_1$ and $M_2$ each represents a hydrogen atom ion or an alkali metal ion.

9. The silver halide light-sensitive photographic material of claim 8, wherein a content of silver iodide is 0.5 to 3.0 mol % of a total silver halide.

10. The silver halide light-sensitive photographic material of claim 8, wherein the compound represented by formula I is added to the silver halide emulsion before the emulsion is coated onto the support.

11. The silver halide light-sensitive photographic material of claim 8, wherein a content of the compound represented by formula I is 1 to 500 mg per mol of silver halide.

12. The silver halide light-sensitive photographic material of claim 11, wherein said compound of formula I is selected from the group consisting of compounds I-1, I-2, I-3, I-4, I-5, I-6, I-7, I-8, I-9, I-10, I-11, I-12, I-13, I-14, I-15, I-16, I-17, I-18, I-19, I-20, I-21, I-22, I-23, I-24, I-25, I-26, I-27, I-28, I-29, I-30, I-31 and I-32 as shown below:

I-1: 2-Amino-4,6-dimercapto-triazine
I-2: 2-Methylamino-4,6-dimercapto-trizine
I-3: 2-Ethylamino-4,6-dimercapto-triazine
I-4: Sodium 2-amino-4,6-dimercapto-triazine
I-5: 2-Pentylamino-4,6-dimercapto-triazine
I-6: 2-Octylamino-4,6-dimercapto-triazine
I-7: 2-Chloroethylamino-4,6-dimercapto-triazine
I-8: 2-Cyanoethylamino-4,6-dimercapto-triazine
I-9: 2-Acetoxyethylamino-4,6-dimercapto-triazine
I-10: 2-Dimethylamino-4,6-dimercapto-triazine
I-11: 2-Dipropylamino-4,6-dimercapto-triazine
I-12: 2-Di-t-butylamino-4,6-dimercapto-triazine
I-13: 2-N-ethyl-N-isoamylamino-4,6-dimercapto-triazine
I-14: 2-pyrrolidino-4,6-dimercapto-triazine
I-15: 2-Morpholino-4,6-dimercapto-triazine
I-16: 2-N-methylanilino-4,6-dimercapto-triazine
I-17: 2-o-Tolylamino-4,6-dimercapto-triazine
I-18: 2-N,N-diphenylamino-4,6-dimercapto-triazine
I-19: 2-Anilino-4,6-dimercapto-triazine
I-20: 2-(2,5-xylamino)-4,6-dimercapto-triazine
I-21: 2-Naphthylamino-4,6-dimercapto-triazine
I-22: 2-Benzylamino-4,6-dimercapto-triazine
I-23: 2-p-Methoxyphenylamino-4,6-dimercapto-triazine
I-24: 2-Benzidino-4,6-dimercapto-triazine
I-25: Sodium 2-N-ethylanilino-4,6-dimercapto-triazine
I-26: 2-N-ethyl-p-tolylamino-4,6-dimercapto-triazine
I-27: 2-p-Chloroanilino-4,6-dimercapto-triazine
I-28: 2-Cyclopentylamino-4,6-dimercapto-triazine
I-29: 2-N,N-dichlorohexylamino-4,6-dimercapto-triazine
I-30: 2-N,N-diallylamino-4,6-dimercapto-triazine
I-31: 2-N-propenylamino-4,6-dimercapto-triazine
I-32: 2-N-methoxybenzoic acid amino-4,6-dimercapto-triazine.

13. The material of claim 2, wherein said compound of formula I is selected from the group consisting of compounds I-1, I-2, I-3, I-4, I-5, I-6, I-7, I-8, I-9, I-10, I-11, I-12, I-13, I-14, I-15, I-16, I-17, I-18, I-19, I-20, I-21, I-22, I-23, I-24, I-25, I-26, I-27, I-28, I-29, I-30, I-31 and I-32 as shown below:

I-1: 2-Amino-4,6-dimercapto-triazine
I-2: 2-Methylamino-4,6-dimercapto-triazine
I-3: 2-Ethylamino-4,6-dimercapto-triazine
I-4: Sodium 2-amino-4,6-dimercapto-triazine
I-5: 2-Pentylamino-4,6-dimercapto-triazine
I-6: 2 -Octylamino-4,6-dimercapto-triazine
I-7: 2-Chloroethylamino-4,6-dimercapto-triazine
I-8: 2-Cyanoethylamino-4,6-dimercapto-triazine
I-9: 2-Acetoxyethylamino-4,6-dimercapto-triazine
I-10: 2-Dimethylamino-4,6-dimercapto-triazine
I-11: 2-Dipropylamino-4,6-dimercapto-triazine
I-12: 2-Di-t-butylamino-4,6-dimercapto-triazine
I-13: 2-N-ethyl-N-isoamylamino-4,6-dimercapto-triazine I-14: 2-pyrrolidino-4,6-dimercapto-triazine
I-15: 2-Morpholino-4,6-dimercapto-triazine
I-16: 2-N-methylanilino-4,6-dimercapto-triazine
I-17: 2-o-Tolylamino-4,6-dimercapto-triazine
I-18: 2-N,N-diphenylamino-4,6-dimercapto-triazine
I-19: 2-Anilino-4,6-dimercapto-triazine
I-20: 2-(2,5-xylamino)-4,6-dimercapto-triazine
I-21: 2-Naphthylamino-4,6-dimercapto-triazine
I-22: 2-Benzylamino-4,6-dimercapto-triazine
I-23: 2-p-Methoxyphenylamino-4,6-dimercapto-triazine
I-24: 2-Benzidino-4,6-dimercapto-triazine
I-25: Sodium 2-N-ethylanilino-4,6-dimercapto-triazine
I-26: 2-N-ethyl-p-tolylamino-4,6-dimercapto-triazine
I-27: 2-p-Chloroanilino-4,6-dimercapto-triazine
I-28: 2-Cyclopentylamino-4,6-dimercapto-triazine
I-29: 2-N,N-dichlorohexylamino-4,6-dimercapto-triazine
I-30: 2-N,N-diallylamino-4,6-dimercapto-triazine
I-31: 2-N-propenylamino-4,6-dimercapto-triazine
I-32: 2-N-methoxybenzoic acid amino-4,6-dimercapto-triazine.

* * * * *